US009113770B2

(12) United States Patent
Dingert et al.

(10) Patent No.: US 9,113,770 B2
(45) Date of Patent: Aug. 25, 2015

(54) CLEANING DEVICE

(75) Inventors: Uwe Dingert, Absteinach (DE); Markus Dietz, Erbes-Budesheim (DE)

(73) Assignee: Carl Freudenberg KG, Weinheim (DE)

( * ) Notice: Subject to any disclaimer, the term of this patent is extended or adjusted under 35 U.S.C. 154(b) by 88 days.

(21) Appl. No.: 13/518,079

(22) PCT Filed: Dec. 15, 2010

(86) PCT No.: PCT/EP2010/007638

§ 371 (c)(1),
(2), (4) Date: Jun. 21, 2012

(87) PCT Pub. No.: WO2011/085771

PCT Pub. Date: Jul. 21, 2011

(65) Prior Publication Data

US 2012/0255138 A1 Oct. 11, 2012

(30) Foreign Application Priority Data

Dec. 21, 2009 (DE) ..... 10 2009 060 009

(51) Int. Cl.
*A47L 13/22* (2006.01)
*A47L 13/20* (2006.01)

(52) U.S. Cl.
CPC . *A47L 13/22* (2013.01); *A47L 13/20* (2013.01)

(58) Field of Classification Search
USPC ..... 401/136–140, 268, 270, 272, 275, 279, 401/282
See application file for complete search history.

(56) References Cited

U.S. PATENT DOCUMENTS

| | | | | |
|---|---|---|---|---|
| 1,618,930 | A | 2/1927 | Istrico | |
| 2,254,487 | A * | 9/1941 | McCune | 401/263 |
| 2,609,557 | A * | 9/1952 | Reed | 401/47 |
| 2,815,522 | A | 12/1957 | Hexter | |
| 5,964,003 | A | 10/1999 | Rogers | |
| 6,227,744 | B1 * | 5/2001 | Fodrocy et al. | 401/284 |
| 6,497,525 | B1 * | 12/2002 | Huang | 401/138 |
| 6,655,866 | B1 * | 12/2003 | Morad et al. | 401/139 |
| 6,663,306 | B2 * | 12/2003 | Policicchio et al. | 401/138 |
| 7,491,005 | B2 * | 2/2009 | Blom | 401/137 |
| 2004/0265037 | A1 | 12/2004 | Vosbikian et al. | |
| 2008/0016634 | A1 | 1/2008 | Vosbikian et al. | |
| 2010/0086342 | A1 | 4/2010 | Blom | |

FOREIGN PATENT DOCUMENTS

| | | | |
|---|---|---|---|
| BE | 536 176 | A | 1/1959 |
| CH | 347 618 | A | 7/1960 |
| DE | 20 2004010 429 | U1 | 9/2004 |
| DE | 10 2004018 364 | A1 | 11/2005 |

* cited by examiner

*Primary Examiner* — David Walczak
(74) *Attorney, Agent, or Firm* — Leydig, Voit & Mayer, Ltd.

(57) ABSTRACT

A cleaning device (1) comprising a handle (2). The handle (2) is formed by a tube (3), which defines a liquid reservoir (4). A nozzle unit (5) is arranged at one end of the handle and a hand grip (6) is arranged at the other end of the handle. An operating device (7) for the nozzle unit (5) is associated with the hand grip (6) The operating device (7) is connected to the nozzle unit (5) by an operative connection (8) arranged in the tube (3).

11 Claims, 4 Drawing Sheets

CLEANING DEVICE

CROSS-REFERENCE TO RELATED APPLICATIONS

The patent application is the national phase of PCT/EP2010/007638, filed Dec. 15, 2010, which claims the benefit of German Patent Application No. 10 2009 060 009.4, filed Dec. 21, 2009.

FIELD OF THE INVENTION

The invention relates to a cleaning device with a handle, the handle being formed from a tube and defining a fluid reservoir.

BACKGROUND OF THE INVENTION

Cleaning devices with a handle and a fluid tank fastened thereto are known from prior art. The tank is frequently removable so that it is easier to fill. The fluid is usually applied to a floor to be cleaned via an outlet by opening a valve. It is disadvantageous that these cleaning devices are unwieldy due to the attached tank. Moreover, the cleaning fluid exits in a free outflow from the valve, i.e., influenced only by gravity. This results in a spray jet with a short range and little scattering. A cleaning device having a handle formed from a tube that defines a fluid reservoir is known from U.S. Pat. No. 7,491,005. An actuating device that can be pushed into the handle is inserted into the handle at the upper end. The space defining the fluid reservoir is reduced due to the insertion, and the fluid is compressed. Thereby the fluid flows out of the nozzle unit under high pressure and is finely atomized. It is disadvantageous in this configuration that the cleaning device is complicated to maneuver because the actuation device for expelling the fluid must be moved up and down while simultaneously the cleaning device must be guided in circular movements over the floor to be cleaned.

SUMMARY OF THE INVENTION

An object of the invention is to provide a compact cleaning device that is easy to maneuver and that thoroughly atomizes the cleaning fluid.

To this end, the cleaning device may include a handle, the handle being formed from a tube that defines a fluid reservoir, a nozzle jet arranged at one end of the handle and a handgrip at the other of the handle. An actuating device for the nozzle unit is associated with the handgrip. The actuating device is connected to the nozzle unit via an operative connection inside the tube. The handgrip allows ergonomic maneuvering of the cleaning device independent of the actuation of the nozzle unit. The handgrip preferably has an angular shape and thus projects from the handle. Thereby the cleaning device fits particularly comfortably in the hand. The actuating unit is associated with the handgrip and is preferably constructed as a lever that can be actuated with one or more fingers. Thus the cleaning work, i.e., the actual mopping process, can be combined with the application of the cleaning fluid as the user desires, both processes being executable ergonomically. The nozzle unit consists of a pump body and a nozzle by which the cleaning fluid is atomized and applied to the floor to be cleaned. The pressure can be built up in the pump body purely mechanically or with support from an electric motor. The nozzle unit can correspondingly be triggered mechanically by the actuating unit via a type of connecting rod or by an electrical actuating mechanism. This nozzle projects at an angle from the handle, so that the cleaning fluid is applied to the floor with a certain throw width. The handle preferably consists of a metallic material since that provides a high degree of stability with a low wall thickness. The handgrip and the nozzle unit preferably consist of plastic shaped by injection molding. To improve its ergonomics and grip, the handgrip can comprise sections made of thermoplastic elastomer. The handgrip with the actuating device is preferably formed in the manner of a pistol handle, since such a grip fits the hand especially well.

The nozzle unit can comprise a pump atomizer. The pump atomizer comprises a pump body and a nozzle. The pump body can comprise a cylinder in which a piston is in turn arranged. The piston slides back and forth axially in the cylinder and increases or reduces the space defined by the cylinder and the piston. The piston points in the direction of the handgrip and is operatively connected to the actuating device and can accordingly be moved up and down by operating the actuating device. The piston has an opening that is closed off by a check valve. The check valve is constructed so that it opens when the piston moves upward, i.e., the space increases. In the process, cleaning fluid can enter the space. The cylinder has another opening that is closed off by a check valve. This additional check valve is constructed so that it opens when the piston moves downward, i.e., the space decreases. In the process the cleaning fluid is ejected from the space, atomized by the nozzle following the additional check valve and applied to the floor to be cleaned. Both check valves advantageously have a spring-loaded ball that can be pushed against a constricted cross-section.

The nozzle unit can comprise a fastening device for a cleaning body. The fastening device can be constructed as a plug connection or a threaded connection. Thereby a wide variety of cleaning bodies can be mounted on the cleaning device. The integration of the fastening device into the nozzle unit results in a compact overall shape with few components.

The operative connection can be produced by an additional tube arranged inside the handle tube. In contrast to a rod, a tube has an increased bending stability, so that the additional tube can be thin-walled with sufficient stability and therefore can have a lightweight construction. Other conceivable operative connections are profile pieces, in particular, cross profiles. They also have an increased bending stability. The additional tube is connected at one end to the actuating device and at the other end to the nozzle unit or the piston of the nozzle unit.

The additional tube can be provided with openings. The openings are preferably arranged at both ends. It is therefore possible to use the volume enclosed by the additional tube as a fluid reservoir. Thereby the fluid reservoir of the cleaning device, and thus its range, is increased.

Spacers can be associated with the additional tube. The spacers are arranged on the additional tube separated from one another by a distance and project from the additional tube in the direction of the inside wall of the tube. Under a pressure stress, the spacers limit the bending of the additional tube and therefore prevent increased friction.

The handgrip can comprise a filling opening for filling the fluid reservoir with a cleaning fluid. The filling opening can be closed by a lid. It can consist of a thermoplastic elastomer. Thereby the lid has a soft construction and harmonizes with the other parts of the handgrip that consist of thermoplastic material. In addition, a profile, by means of which the lid fits tightly on the filling opening, can be produced from the edge on the filling opening. The lid can further be connected permanently to the handgrip with a film hinge. Thereby the lid is arranged in a loss-proof manner on the handgrip, the film hinge being easy to construct. The handgrip delimits a part of the fluid reservoir in addition to the tube, so that the fluid reservoir is further enlarged. The additional tube is introduced into the fluid reservoir in the vicinity of the handgrip, the additional tube being axially movable and sealed off with O-rings.

The handgrip can have at least one transparent section. The transparent section forms a view window through which the fluid level can be checked.

The handgrip and/or the nozzle unit can be pushed into the tube at least partially. The housing unit and the handgrip thus directly close off both ends of the handle, yielding a compact handle unit consisting of handle, handgrip, and nozzle unit with the mounting device. In this configuration, no metallic elements protrude laterally from the tube, so that the dimensions of the handle according to the invention with the fluid reservoir correspond to those of an ordinary handle without a fluid reservoir.

The cleaning device can be constructed as a flat mop or a dust mop. The above-mentioned cleaning devices have multiply usable cleaning bodies, a wiping cover and a mop head with fringe. For a cleaning process, the cleaning body can be merely pre-moistened with water, the cleaning fluid then being provided by separate application of a cleaning fluid from the fluid reservoir onto the floor to be cleaned. Thereby the concentration of cleaning fluid can be determined based on the dirtiness.

BRIEF DESCRIPTION OF THE SEVERAL VIEWS OF THE DRAWINGS

Some exemplary embodiments of the cleaning device according to the invention will be explained in detail below with reference to the Figures.

DETAILED DESCRIPTION OF THE INVENTION

Figure 1:
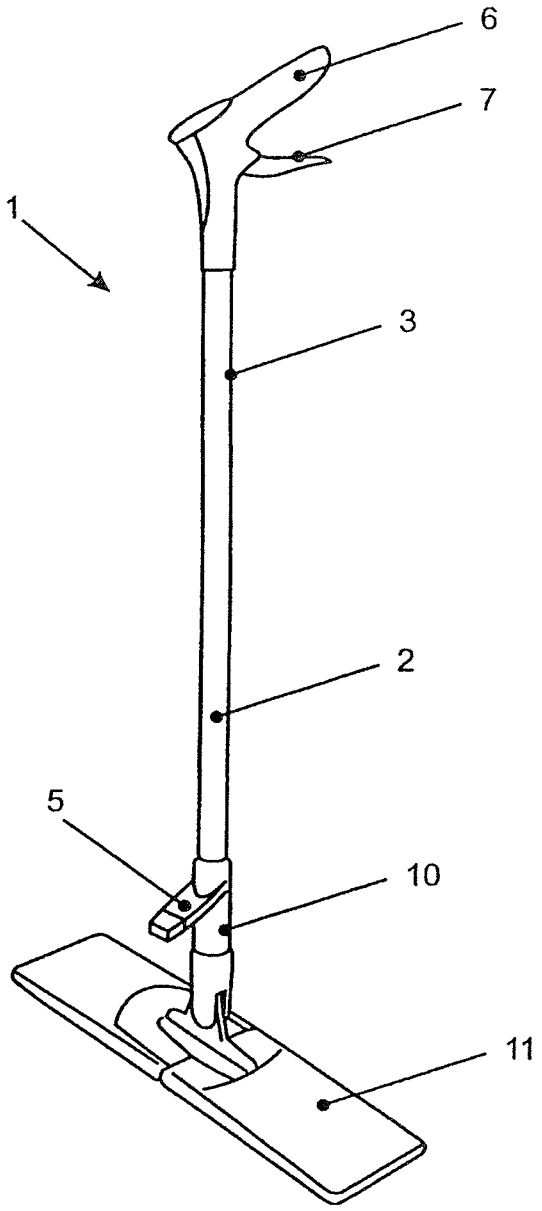
FIG. 1 is a schematic perspective view of an exemplary cleaning device according to the invention configured as a flat mop.

FIG. 1 shows a cleaning device 1 constructed as a flat mop. The cleaning device includes a handle 2, the handle 2 being formed from a metallic tube 3 that defines a fluid reservoir 4 in its interior. A nozzle unit 5 is arranged at one end of the handle and a handgrip 6 is arranged at its other end. The handgrip 6 and the nozzle unit 5 are inserted partially into the tube 3, the connection being closed off by O-rings in each case. The actuating device 7 for the nozzle unit 5 is arranged on the handgrip 6, which is shaped similarly to a pistol grip. The actuating device 7 is configured as a lever and is in contact with an operative connection 8. The latter in turn contacts the nozzle unit 5, so that the nozzle unit 5 can be controlled by actuating device 7 via the operative connection 8. The lever of the actuating device 7 is designed so that it can be operated with one or more fingers, the cleaning device 1 always being maneuverable via the handgrip. The operative connection 8 includes an additional tube 12. The operative connection 8, i.e., the additional tube 12, is arranged inside the tube 3. The additional tube 12 is provided with openings 13 at the upper and lower ends, so that cleaning fluid can flow into the additional tube 12 and back out. The additional tube 12 is furnished with spacers 14 that are separated from one another. The spacers 14 are constructed as rings, the inside diameter thereof being selected in such a manner that the spacers 14 tightly contact the additional tube 12, and the outside diameter being selected so that the spacers 14 are a slight distance away from the inside wall of the tube 3.

Figure 2:
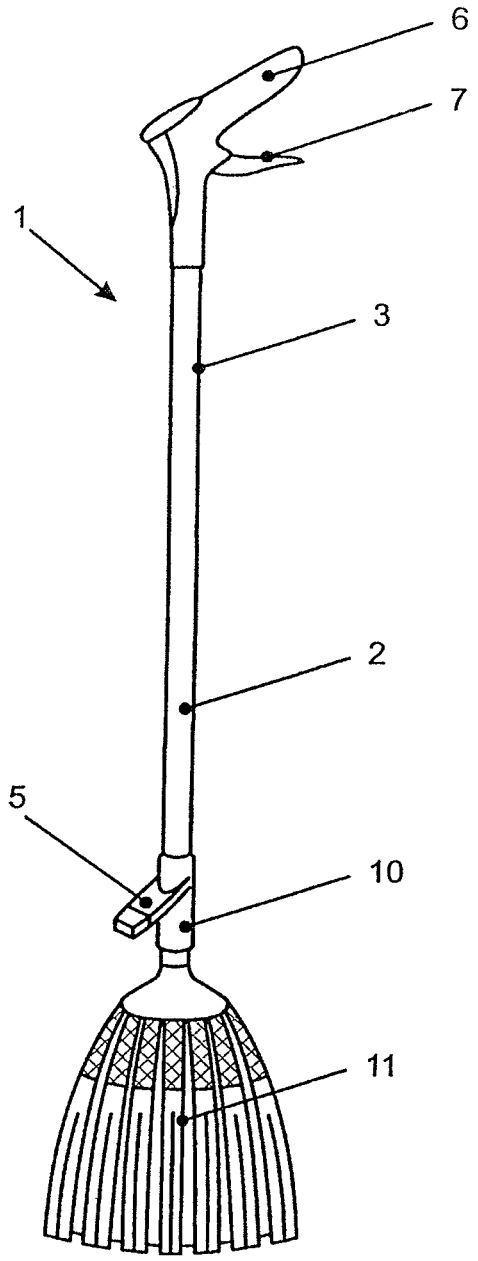
FIG. 2 is a schematic perspective view of an exemplary cleaning device according to the invention configured as a fringe-type mop.

FIG. 2 shows a cleaning device 1 according to FIG. 1, the cleaning device 1 being constructed in this configuration as a dust mop.

Figure 3:
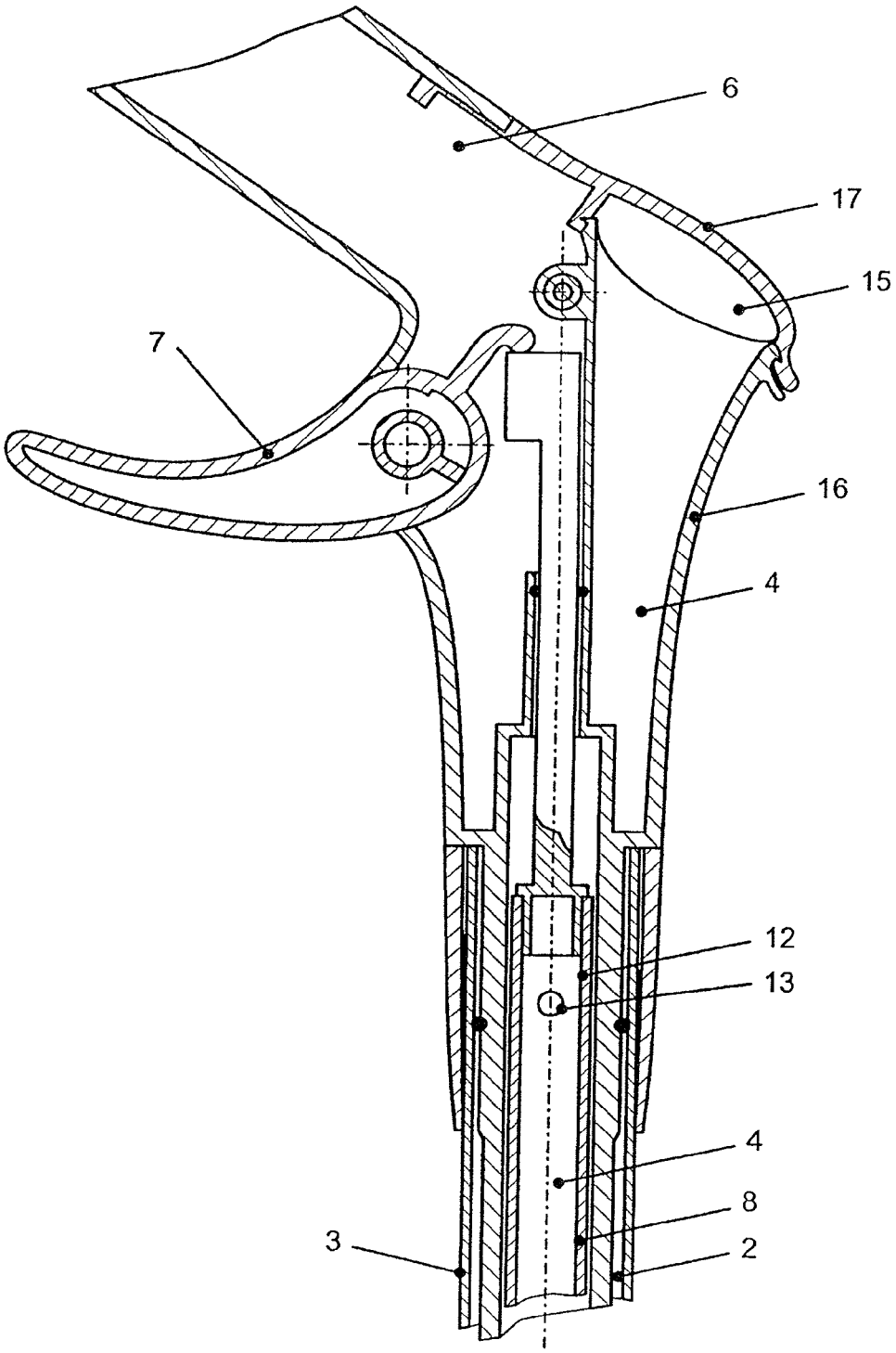
FIG. 3 is a schematic cross-sectional view of the handgrip of the cleaning devices of FIGS. 1 and 2.

FIG. 3 shows the handgrip 6 of the cleaning device according to FIG. 1 in detail. The handle 6 consists of a plastic material, sections thereof that come into contact with the user's hand being formed from a thermoplastic elastomer. The handgrip 6 is inserted into the tube 3 in certain sections. For this purpose, the handgrip 6 has a tubular section that is furnished with grooves into which O-rings are placed, so that the handgrip is connected fluid-tightly to the tube 3. The handgrip 6 has a filling opening 15 for filling the fluid reservoir 4 with a cleaning fluid. It is closed off by a lid 17. The lid 17 is formed from a thermoplastic elastomer and is furnished with a profile on its edge, so that the lid 17 tightly closes the filling opening 15. The lid 17 is further connected in a loss-proof manner to the handgrip 6 with a film hinge. Handgrip 6 has a transparent section 16, formed from a transparent plastic to allow checking of the level of the fluid reservoir 4. The transparent section 16 directly adjoins the filling opening 15. The lever of the actuating device 7 is pivotably mounted in the handgrip 6, the lever having a plunger that contacts the additional tube 12.

Figure 4:
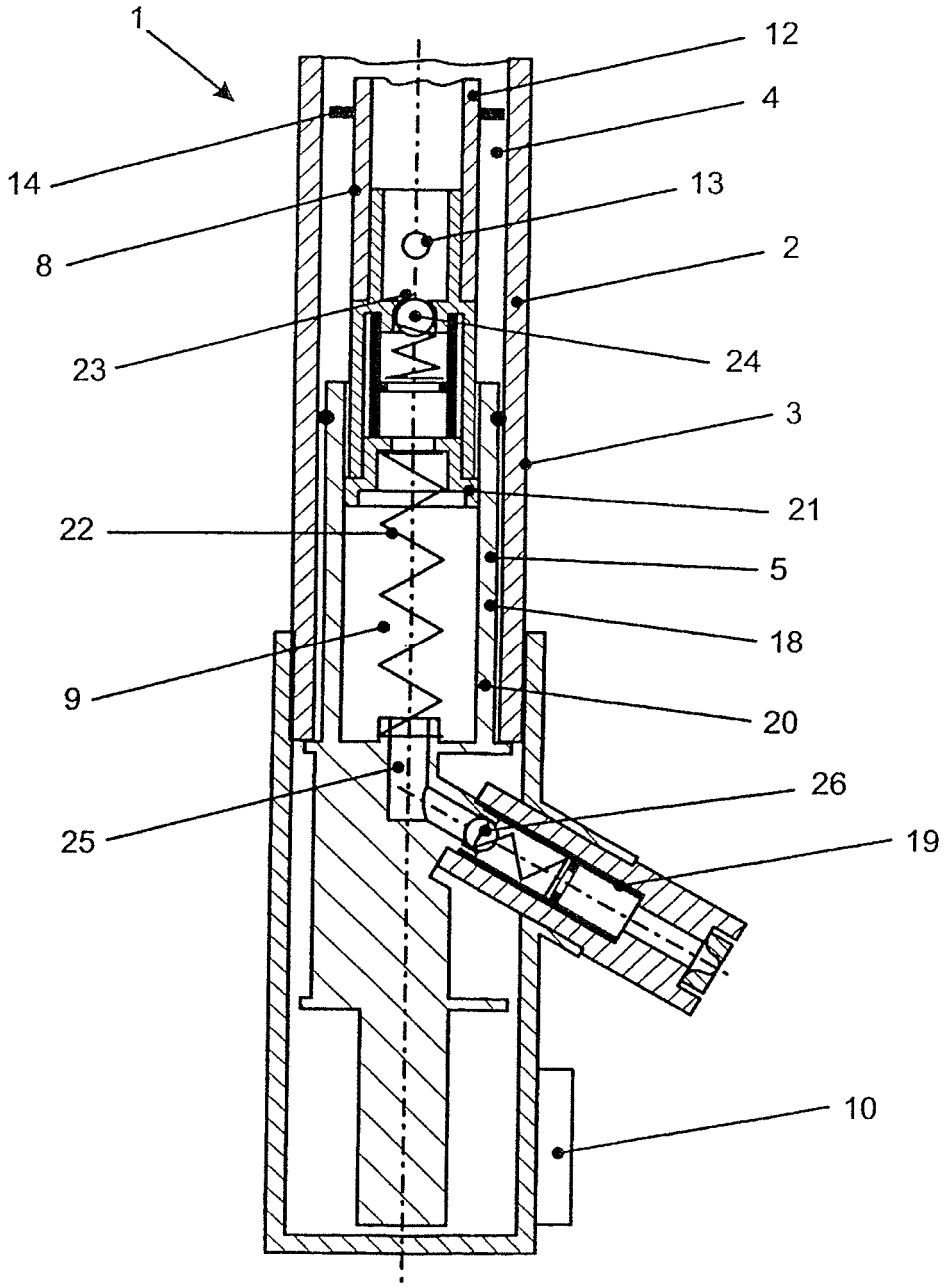
FIG. 4 is a schematic cross-sectional view of the nozzle unit of the cleaning devices of FIGS. 1 and 2.

FIG. 4 shows the nozzle unit 5 of the cleaning device according to FIG. 1 in detail. The nozzle unit 5 comprises a pump atomizer 9. The pump atomizer consists of a pump body 18 and a nozzle 19. The pump body 18 includes a cylinder 20 in which a piston 21 is in turn arranged. The piston 21 slides back and forth axially in the cylinder 20 and increases or reduces the space defined by the cylinder 20 and the piston 21. The piston 21 points in the direction of the handgrip 6, is operatively connected to the actuating device 7, and can accordingly be moved down by operating the actuating device 7. A spring 22, by which the piston 21 is automatically moved upward as soon as the actuating device 7 is released, is arranged in the cylinder 20. The piston 21 has an opening 23 that is closed off by a check valve 24. The check valve 24 is constructed so that it opens when the piston 21 moves upward, i.e., the space increases. In the process, cleaning fluid can enter the space. The cylinder 20 has another opening 25, which is closed off by a check valve 26. This additional check valve 26 is constructed so that it opens when the piston 21 moves downward, i.e., the space decreases. In the process, the cleaning fluid is ejected from the space, atomized by the nozzle 19 following the additional check valve 26 and applied to the floor to be cleaned. Both check valves 24, 26 advantageously have a spring-loaded ball that can be pushed against a constricted cross-section. The nozzle unit 5 has a tubular section that is inserted into the tube 3. The section is furnished with grooves into which O-rings are inserted, so that the nozzle unit 5 is connected fluid-tightly to the tube 3. A fastening device 10 for a cleaning body 11 is molded onto the nozzle unit 5.

The invention claimed is:

1. A cleaning device comprising:

a handle, the handle being formed from a tube that defines a fluid reservoir;

a nozzle jet unit arranged at one end of the handle;

a handgrip arranged at the other end of the handle, the handgrip projecting away from the handle at an angle relative to a first axis that extends longitudinally relative to the handle and a second axis that extends perpendicularly relative to the handle such that the handgrip extends along a handgrip axis that is closer to the second axis than the first axis; and an actuating device for the nozzle unit associated with the handgrip;

wherein the actuating device is connected to the nozzle jet unit via an operative connection that is arranged entirely inside the tube, the actuating device comprising a lever that is actuatable by one or more fingers of a user, the operative connection including an additional tube disposed inside the tube and extending between the actuating device and the nozzle jet unit, the additional tube operating as a pushrod to activate the nozzle jet unit when the lever is actuated, the additional tube further being hollow to form therethrough a fluid passageway such that, when the lever is actuated, a fluid is adapted to pass from the fluid reservoir to the nozzle jet unit through the additional tube.

2. The cleaning device according to claim 1, wherein the nozzle unit comprises a pump atomizer.

3. The cleaning device according to claim 2, wherein the nozzle unit comprises a fastening device for a cleaning body.

4. The cleaning device according to claim 1, wherein the additional tube has openings formed adjacent its ends, the openings configured to fluidly connect a hollow interior of the additional tube with the fluid reservoir and the nozzle jet unit.

5. The cleaning device according to claim 4, wherein spacers are associated with the additional tube.

6. The cleaning device according to claim 1, wherein the handgrip has a filling opening for filling the fluid reservoir with a cleaning fluid.

7. The cleaning device according to claim 1, wherein the handgrip has at least one transparent section.

8. The cleaning device according to claim 1, wherein the handgrip is inserted at least in certain sections into the tube.

9. The cleaning device according to claim 1, wherein the nozzle unit is inserted at least in certain sections into the tube.

10. The cleaning device according to claim 1, wherein the cleaning device is constructed as a flat mop.

11. The cleaning device according to claim 1, wherein the cleaning device is constructed as a fringe-type mop.

* * * * *